US006702587B2

(12) United States Patent
Weiss et al.

(10) Patent No.: US 6,702,587 B2
(45) Date of Patent: Mar. 9, 2004

(54) SEPARABLE ELECTRICAL CONNECTOR USING ANISOTROPIC CONDUCTIVE ELASTOMER INTERCONNECT MEDIUM

(75) Inventors: Roger E. Weiss, Foxboro, MA (US); Christopher Cornell, South Dartmouth, MA (US)

(73) Assignee: Paricon Technologies Corporation, Fall River, MA (US)

( * ) Notice: Subject to any disclaimer, the term of this patent is extended or adjusted under 35 U.S.C. 154(b) by 0 days.

(21) Appl. No.: 10/215,395

(22) Filed: Aug. 8, 2002

(65) Prior Publication Data

US 2003/0032310 A1 Feb. 13, 2003

Related U.S. Application Data

(60) Provisional application No. 60/311,178, filed on Aug. 8, 2001.

(51) Int. Cl.[7] ..... H01R 9/09
(52) U.S. Cl. ..... 439/66; 439/67
(58) Field of Search ..... 439/91, 71, 66, 439/331, 67

(56) References Cited

U.S. PATENT DOCUMENTS 4,969,828 A * 11/1990 Bright et al. ..... 439/68
6,027,346 A * 2/2000 Sinsheimer et al. ..... 439/66
6,069,024 A * 5/2000 Murakami ..... 438/108
6,097,609 A * 8/2000 Kabadi ..... 361/760
6,239,383 B1 * 5/2001 Lin ..... 174/260
6,341,963 B1 * 1/2002 Hussain ..... 439/71
6,375,476 B1 * 4/2002 Goodwin et al. ..... 439/71
6,439,897 B1 * 8/2002 Ikeya ..... 439/73
6,447,308 B1 * 9/2002 McCarthy et al. ..... 439/91

* cited by examiner

*Primary Examiner*—Neil Abrams
*Assistant Examiner*—Phuong K T Dinh
(74) *Attorney, Agent, or Firm*—Brian M. Dingman, Esq.; Mirick, O'Connell, DeMallie & Lougee, LLP

(57) ABSTRACT

An electrical connector for separably, electrically interconnecting an electrical device to a main circuit board using anisotropic conductive elastomer (ACE) as part of the interconnect, the electrical connector comprising an adapter board coupled to the main board on one side, the other side of the adapter board defining connecting lands; a layer of ACE on the other side of the adapter board, the other side of the ACE in contact with the device; and a mechanical compression structure coupled to the adapter board, and that provides a compressive load on the device, the ACE and the adapter board, to accomplish a separable electrical connection between the device and the main board, through the ACE and the adapter board.

36 Claims, 4 Drawing Sheets

SEPARABLE ELECTRICAL CONNECTOR USING ANISOTROPIC CONDUCTIVE ELASTOMER INTERCONNECT MEDIUM

CROSS REFERENCE TO RELATED APPLICATION

This application claims priority of Provisional application Ser. No. 60/311,178, filed on Aug. 8, 2001.

FIELD OF THE INVENTION

This invention relates to electrical interconnect devices.

BACKGROUND OF THE INVENTION

Anisotropic Conductive Elastomer (ACE) is a composite of conductive metal elements in an elastomeric matrix that is normally constructed such that it conducts along one axis only. In general, ACE is made to conduct through its thickness. One form of ACE material is made by mixing magnetic particles with a liquid resin, forming the mix into a continuous sheet, and curing the sheet in the presence of a magnetic field. This results in the particles forming a large number of closely spaced columns through the sheet thickness. The columns are electrically conductive. The resulting structure has the unique property of being both flexible and anisotropically conductive. These properties provide for an enabling interconnection medium which, when combined with other technologies, make it possible to realize new interconnect capabilities.

ACE materials require that they be compressed between top and bottom conductors to provide the interconnection. This is normally done by compressing the system using a backing plate and spring arrangement. One example of such is shown in FIG. 1. This system can be used only with boards 12 which are designed to accommodate the backing plate 22, and has holes for the connection hardware 28, 29, to pass through, to connect spring plate 24 (with spring force adjustment screw 26) to pressure member 15. Device 14 is electrically interconnected to board 12 using ACE 20. Heat sink 30 is optional in the system. This can result in a conflict with components mounted under the device and on the back of the board.

ACE material can be married with flexible circuits to provide more dynamic range to an ACE interconnect. The flexible circuit consists of an electrically-insulating material such as polyimide, with opposing conductive pads on the surfaces. The pads are vertically interconnected by plated-through holes. Mounting such a flex circuit to ACE material can provide more vertical compliance to the ACE material. This allows the ACE material to be used in assemblies that are not planar, such as circuit boards with solder mask, in which the circuit board pads are lower than the top of the solder mask, thus creating a small well around each pad and into which the ACE material-based interconnect must protrude in order to make electrical contact with the pads.

BGA (ball grid array) devices are electronic components with solder balls placed in a grid and used for final installation (through a solder reflow process) on a printed circuit board. There are other types of electronic packages in which the invention is relevant, including Land Grid Arrays (LGA). Column Grid Arrays (CGA) have solder columns in place of the ball or pad. Factors such as cost, environment and population density determine which geometry is used.

SUMMARY OF THE INVENTION

The present invention combines ACE with an adapter board that eliminates the need for a specially modified main board in order to mechanically compress the ACE.

This invention features an electrical connector for separably, electrically interconnecting an electrical device to a main circuit board using anisotropic conductive elastomer (ACE) as part of the interconnect, the electrical connector comprising an adapter board coupled to the main board on one side, the other side of the adapter board defining connecting lands; a layer of ACE on the other side of the adapter board, the other side of the ACE in contact with the device; and a mechanical compression structure coupled to the adapter board, and that provides a compressive load on the device, the ACE and the adapter board, to accomplish a separable electrical connection between the device and the main board, through the ACE and the adapter board.

The connector may further comprise a heat sink coupled to the compression structure and in communication with the device, for removing heat from the device. The connector may further comprise a thermal conducting medium between the device and the heat sink. The ACE material may be formed by magnetically aligned particles that form columns extending between the top and bottom surface of the ACE.

The connector may further comprise a flex circuit between the device and the ACE. The flex circuit may comprise ball seats on one surface and lands on the other surface. The connector may further comprise an insulating adhesive backfill between the adapter board and the main board, to enhance the stiffness of the adaptor board. The backfill may be epoxy. The connector mechanical compression structure may comprise a plate. The mechanical compression structure may further comprise hinge members and a latch for moving and latching the plate. The mechanical compression structure may comprise a compressive spring element. The mechanical compression structure may further comprise a mechanical member for applying a variable compressive load. The connector may further comprise a spacer frame between at least a portion of the adapter board and the main board, to further thicken and stiffen the adapter.

Also featured is an electrical connector for separably, electrically interconnecting an electrical device to a main circuit board using anisotropic conductive elastomer (ACE) as part of the interconnect, the electrical connector comprising: an adapter board coupled to the main board on one side, the other side of the adapter board defining connecting lands; a layer of ACE on the other side of the adapter board, the other side of the ACE in contact with the device; and a mechanical compression structure coupled to the adapter board, and that provides a compressive load on the device, the ACE and the adapter board, to accomplish a separable electrical connection between the device and the main board, through the ACE and the adapter board; wherein the mechanical compression structure comprises a compressive spring element and a mechanical member for applying a variable compressive load.

The ACE material may comprise conductive particles embedded in an elastomer, the conductive particles defining the conductive columns. The flexible circuit element conductive pathways may comprise conductor-lined openings extending between the opposing faces of the flexible circuit element. The flexible circuit element may further define conductive pads on both faces of the flexible circuit element and in electrical contact with a conductive pathway, to provide electrical contact areas on the flexible circuit element, one contact area for interfacing with the ACE material, and the other contact area for interfacing with an electrical device.

The conductive pads on one face of the flexible circuit element may be annular, each surrounding a conductive pathway. The electrical device may comprise an electrical package with a series of electrical contact members protruding from a face thereof. The protruding electrical contact members may define an external peripheral shape, and the inside of the annular conductive pads may define the same shape, so that a protruding electrical contact member contacts a conductive pad about the entire periphery of the protruding electrical contact member.

The electrical package may comprise a ball grid array (BGA) with a series of external, partially-spherical contact members, and the inside of the annular conductive pads may define a circle having a diameter smaller than that of the spherical contact member, so that the contact member seats in the pad. The contact member may contact the pad such that the angle defined by coplanar radii from the contact member center to the contact member pad contact locations is approximately 90°.

The electrical package may comprise a land grid array (LGA) with a series of external rectangular contact members, and the conductive pads may be rectangular, to provide effective electrical contact therebetween. The electrical package may comprise a column array (CGA) with a series of external projecting column contact members. The conductive pads on the face of the flexible circuit element in contact with the ACE may be continuous, in order to maximize contact with the conductive columns in the ACE.

BRIEF DESCRIPTION OF THE DRAWINGS

Other objects, features and advantages will occur to those skilled in the art from the following description of the preferred embodiments, and the accompanying drawings in which.

DESCRIPTION OF THE PREFERRED EMBODIMENTS OF THE INVENTION

Figure 1:
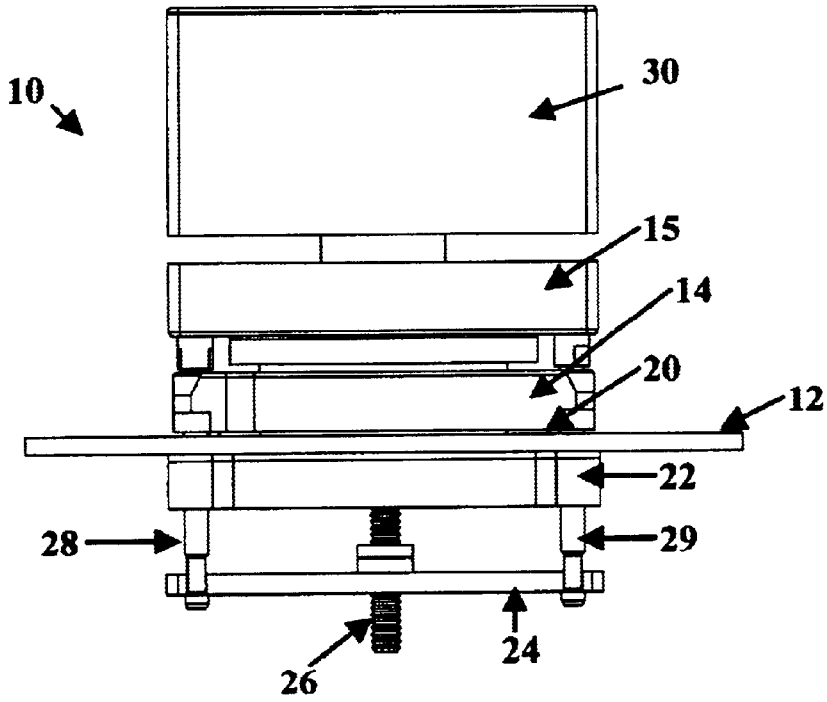
Prior Art Figure 1
FIG. 1 is a schematic diagram of a prior art ACE compression system.
Figure 2:
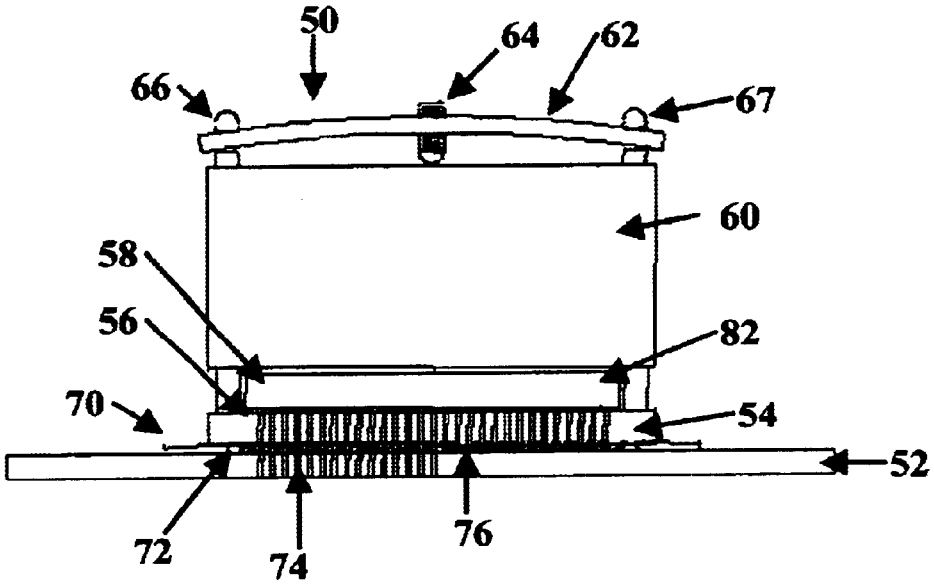
FIG. 2 is a schematic diagram of a preferred embodiment of the separable electrical connector of this invention.

FIG. 2 provides a view of one preferred embodiment of the present invention. In this invention, adapter board 54 is attached to the main board 52 using conventional technology such as BGA (Ball Grid Array) 76. For descriptive purposes, FIG. 2 indicates both pin/through-hole mounting 74 and BGA surface mounting 76. In practice, one or the other is most likely to be used. Further rigidity of the attachment of adapter board 54 can be provided by a spacer frame 70 rigidly affixed to adapter board 54 and placed between adapter board 54 and printed circuit board (PCB) 52. Frame 70 which when present is attached to adapter 54, will thicken adapter 54 and provide stiffness. This may only be required for large area devices. Adapter board 54 can have BGA on one side and flat lands on the other side, to provide a mechanical translation from the BGA solder format to the flat land format optimally used for the ACE material 56. Adapter 54 can also be used to rearrange the electrical contacts on board 52 to better match those on the device being connected 58. This allows the use of what is referred to as a mother board to daughter board interconnection. Adapter board 54 can be made of an appropriately rigid insulator such as epoxy or ceramic. It can contain metal members to provide additional stiffness.

Adapter board 54 serves as the platform for the compressive interconnection between ACE material 56 and device 58. In the preferred embodiment shown in FIG. 2, mechanical connectors such as retaining pins 66 are provided at appropriate positions along the edge and/or surface of adapter board 54 to affix an upper plate 62 which serves as the spring member which compresses device 58 through ACE 56 to adapter board 54. In one preferred embodiment upper plate 62 can incorporate heat sink 60 and a heat spreader (a thermal conducting medium) 82.

The structure described above and shown in FIG. 2 provides a mechanical couple between upper plate 62 and adapter board 54 which compresses ACE 56 between device 58 and adapter board 54, resulting in a quality, separable interconnect. By using adapter board 54, which is typically stiffer than main board 52, less stress is placed on the solder joint interconnecting adapter board 54 to PCB 52. Additional stiffness can be added by injecting an insulating (non conducting) adhesive substance to backfill the spaces between solder joints, such as epoxy underfill 72, between the bottom of adapter 54 and PCB 52. This encapsulates the solder joints, helps to bond boards 52 and 54, and relieves additional stress from the reflowed solder joints.

Figure 3:
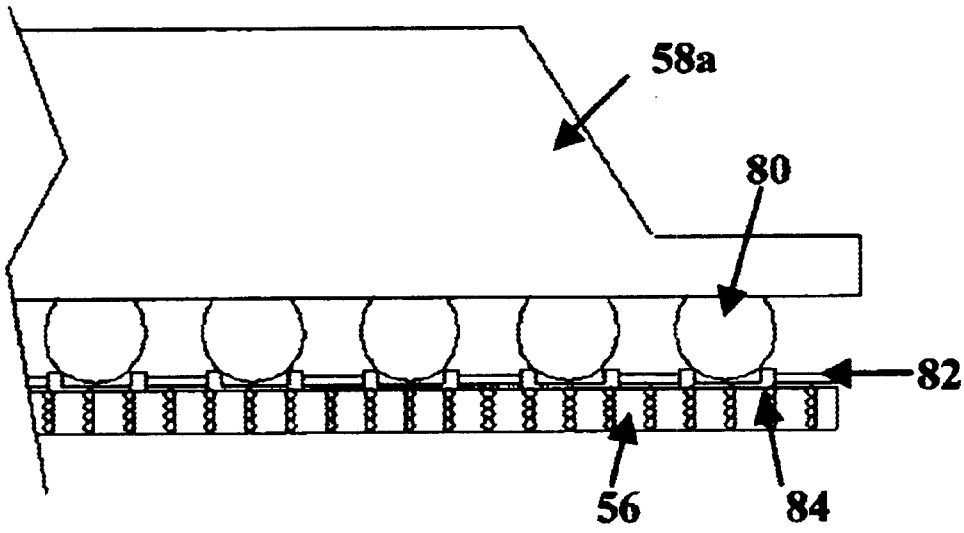
FIG. 3 is a greatly enlarged partial view of a BGA package coupled to ACE material using a flexible circuit according to one aspect of this invention.
Figure 4:
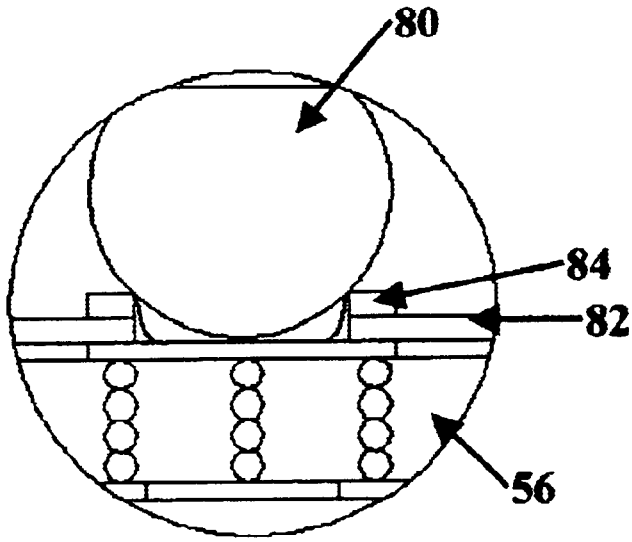
FIG. 4 is a schematic expanded view of a single solder ball interconnected to a board using the flexible circuit interconnect shown in FIG. 3.

When a BGA type device 58*a*, FIG. 3, is being attached to the PCB using the adapter, a flex circuit 82 can be added between the balls 80 of BGA 58*a* and ACE 56. This can be designed with large radius plated holes 84 on the upper surface of flex circuit 82, to protect the bottom of solder ball 80 as indicated in FIG. 3. The bottom side of the flex preferably has continuous pads (flat lands) at the plated through hole, providing an optimum interconnection surface for ACE 56.

Figure 5:
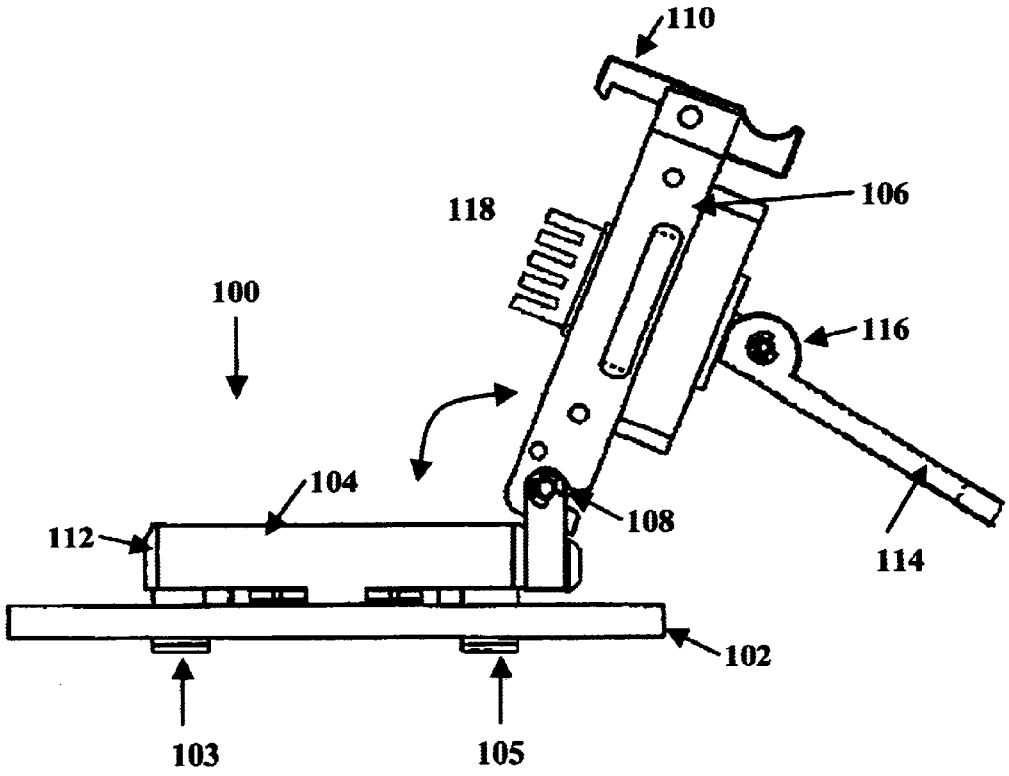
FIG. 5 is a side view of another embodiment of the invention with an easily separable connector using a pivot and latch mechanism.

In another preferred embodiment, FIG. 5, a quick attachment mechanism using a latch and a pivot can be employed to facilitate the quick insertion and removal of devices from the adapter board. Main PCB 102 has an adapter board, ACE and the electrical device on top of it, within housing member 104, that itself is attached to board 102 by bolts 103 and 105. Upper housing member 106 is pivotably, removably coupled to member 104 at pivot bar 108. Latching member 110 engages with end 112 of member 104 to hold member 106 on member 104 in the down (engaged) position (not shown in the drawing). Pivoting arm 114 with cam 116 is enabled to compress and release a spring (not shown) in housing 106, which is held against the top of heat sink 118. When the spring is released, it pushes down on heat sink 118. Since heat sink 118 lies against the device when the assembly is closed, this force pushes down on the device and the ACE, to create the good electrical connection between the device and board 102. With this system, the device can be engaged with board 102 by placing the device and ACE in member 104, and then bringing member 106 down, and releasing the spring that pushes heat sink 118 against the top of the device, to thereby accomplish the electrical connection from the device to board 102 through the ACE.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. An electrical connector for separably, electrically interconnecting an electrical device to a main circuit board using anisotropic conductive elastomer (ACE) as part of the interconnect, wherein the electrical device comprises projecting electrical contacts to be electrically coupled to the main board, the electrical connector comprising:

an adapter board coupled to the main board on one side, the other side of the adapter board defining connecting lands;

a layer of ACE, one side of the ACE coupled to the side of the adapter board defining connecting lands;

a flex circuit in contact with the other side of the ACE, and in contact with the device, the flex circuit defining connecting lands on one surface that are in contact with the ACE, the flex circuit defining conductive seats on its other surface that comprise annular pads that contact the projecting contacts along a contact region above the bottoms of the protecting contacts, and allow the bottoms of the projecting contacts to project through the annular pads; and a mechanical compression structure coupled to the adapter board, and that provides a compressive load on the device, the ACE and the adapter board, to accomplish a separable electrical connection between the device and the main board, through the ACE and the adapter board.

2. The connector of claim 1 further comprising a heat sink coupled to the compression structure and in communication with the device, for removing heat from the device.

3. The connector of claim 2 further comprising a thermal conducting medium between the device and the heat sink.

4. The connector of claim 1 wherein the ACE material is formed by magnetically aligned particles that form columns extending between the top and bottom surface of the ACE.

5. The connector of claim 1 further comprising an insulating adhesive backfill between the adapter board and the main board, to enhance the stiffness of the adaptor board.

6. The connector of claim 5 wherein the backfill is epoxy.

7. The connector of claim 1 wherein the mechanical compression structure comprises a plate.

8. The connector of claim 1 wherein the mechanical compression structure comprises a pivot and a latch.

9. The connector of claim 1 wherein the mechanical compression structure comprises a compressive spring element.

10. The connector of claim 9 wherein the mechanical compression structure further comprises a mechanical member for applying a variable compressive load.

11. The connector of claim 1 further comprising a frame rigidly affixed to the adapter board and located between a peripheral portion of the adapter board and the main board, to stiffen the adapter.

12. The connector of claim 1, wherein the electrical contacts of the electrical device comprise generally spherical shaped contacts, and the annular pads contact the generally spherical shaped contacts along a contact region above the bottoms of the generally spherical shaped contacts, and allow the bottoms of the generally spherical shaped contacts to project through the annular pads.

13. An electrical connector for separably, electrically interconnecting an electrical device to a main circuit board using anisotropic conductive elastomer (ACE) as part of the interconnect, wherein the electrical device comprises projecting electrical contacts to be electrically coupled to the main board, the electrical connector comprising:

an adapter board coupled to the main board on one side, the other side of the adapter board defining connecting lands;

a layer of ACE, one side of the ACE coupled to the side of the adapter board defining connecting lands, and the other side of the ACE electrically connected to the device;

an insulating adhesive backfill between the main board and the adapter board, to enhance the stiffness of the adapter board;

a flex circuit in contact with the other side of the ACE, and in contact with the device, the flex circuit defining connecting lands on one surface that are in contact with the ACE, the flex circuit defining conductive seats on its other surface that comprise annular pads that contact the projecting contacts along a contact region above the bottoms of the projecting contacts, and allow the bottoms of the projecting contacts to project through the annular pads; and a mechanical compression structure coupled to the adapter bond, and that provides a compressive load on the device, the ACE and the adapter board, to accomplish a separable electrical connection between the device and the main board, through the ACE and the adapter board.

14. The connector of claim 13, further comprising a heat sink coupled to the compression structure and in communication with the device, for removing heat from the device.

15. The connector of claim 14, further comprising a thermal conducting medium between the device and the heat sink.

16. The connector of claim 13 wherein the ACE material is formed by magnetically aligned particles that form columns extending between the top and bottom surface of the ACE.

17. The connector of claim 13, further comprising a flex circuit between the device and the ACE.

18. The connector of claim 17 wherein the flex circuit comprises ball seats on one surface and lands on the other surface.

19. The connector of claim 13 wherein the backfill is epoxy.

20. The connector of claim 13 wherein the mechanical compression structure comprises a plate.

21. The connector of claim 13 wherein the mechanical compression structure comprises a pivot and a latch.

22. The connector of claim 13 wherein the mechanical compression structure comprises a compressive spring element.

23. The connector of claim 22 wherein the mechanical compression structure further comprises a mechanical member for applying a variable compressive load.

24. The connector of claim 13, further comprising a frame rigidly affixed to the adapter board and located between a peripheral portion of the adapter board and the main board, to stiffen the adapter board.

25. An electrical connector for separably, electrically interconnecting an electrical device to a main circuit board using anisotropic conductive elastomer (ACE) as part of the interconnect, wherein the electrical device comprises projecting electrical contacts to be electrically coupled to the main board, the electrical connector comprising:

an adapter board coupled to the main board on one side, the other side of the adapter board defining connecting lands;

a frame rigidly affixed to the adapter board and located between a peripheral portion of the adapter board and the main board, to stiffen the adapter board;

a layer of ACE, one side of the ACE coupled to the side of the adapter board defining connecting lands, and the other side of the ACE electrically connected to the device; and a flex circuit in contact with the other side of the ACE, and in contact with the device, the flex circuit defining connecting lands on one surface that are in contact with the ACE, the flex circuit defining conductive seats on its other surface that comprise annular pads that contact the projecting contacts along a contact region above the bottoms of the projecting contacts, and allow the bottoms of the projecting contacts to project through the annular pads; and a mechanical compression structure coupled to the adapter board, and that provides a compressive load on the device, the ACE and the adapter board, to accomplish a separable electrical connection between the device and the main board, trough the ACE and the adapter board.

26. The connector of claim 25, further comprising a heat sink coupled to the compression structure and in communication with the device, for removing heat from the device.

27. The connector of claim 26, further comprising a thermal conducting medium between the device and the heat sink.

28. The connector of claim 25 wherein the ACE material is formed by magnetically aligned particles that form columns extending between the top and bottom surface of the ACE.

29. The connector of claim 25, further comprising a flex circuit between the device and the ACE.

30. The connector of claim 29, wherein the flex circuit comprises ball seats on one surface and lands on the other surface.

31. The connector of claim 25, further comprising an insulating adhesive backfill between the main board and the adapter board, to enhance the stiffness of the adapter board.

32. The connector of claim 31 wherein the backfill is epoxy.

33. The connector of claim 25 wherein the mechanical compression structure comprises a plate.

34. The connector of claim 25 wherein the mechanical compression structure comprises a pivot and a latch.

35. The connector of claim 25 wherein the mechanical compression structure comprises a compressive spring element.

36. The connector of claim 35 wherein the mechanical compression structure further comprises a mechanical member for applying a variable compressive load.

* * * * *